United States Patent [19]

Siems

[11] Patent Number: 4,875,494

[45] Date of Patent: Oct. 24, 1989

[54] METHOD OF AND APPARATUS FOR MAKING A ROD OF FIBROUS MATERIAL

[75] Inventor: Wolfgang Siems, Hamburg, Fed. Rep. of Germany

[73] Assignee: Körber, Hamburg, Fed. Rep. of Germany

[21] Appl. No.: 152,951

[22] Filed: Feb. 5, 1988

[30] Foreign Application Priority Data

Feb. 21, 1987 [DE] Fed. Rep. of Germany ..... 3705576

[51] Int. Cl.[4] ..... A24C 5/14; A24C 5/39

[52] U.S. Cl. ..... 131/84.1; 131/84.3; 131/84.4

[58] Field of Search ..... 131/84.1, 84.3, 84.4, 131/904, 905, 906

[56] References Cited

U.S. PATENT DOCUMENTS

| | | | |
|---|---|---|---|
| 3,052,242 | 9/1962 | Levadi | 131/906 X |
| 3,127,899 | 4/1964 | Lloyd et al. | 131/906 X |
| 3,515,860 | 6/1970 | Fitzgerald Jr. | 364/300 |
| 3,738,376 | 6/1973 | Abbe et al. | 131/84.4 |
| 4,063,563 | 12/1977 | Lorenzen | 131/84.4 |
| 4,190,061 | 2/1980 | Heitmann et al. | 131/84.4 |
| 4,280,516 | 7/1981 | Reuland | 131/906 X |
| 4,284,087 | 8/1981 | Reuland | 131/906 X |
| 4,548,215 | 10/1985 | Adebahr | 131/906 X |
| 4,556,071 | 12/1985 | Hoffmann | 131/84.4 |
| 4,595,027 | 6/1986 | Higgins et al. | 131/906 X |

*Primary Examiner*—V. Millin
*Assistant Examiner*—D. F. Crosby
*Attorney, Agent, or Firm*—Peter K. Kontler

[57] ABSTRACT

A tobacco stream, which contains a surplus of tobacco and is converted into a rod-like filler by a trimming device serving to remove the surplus from successive increments of the stream, is monitored ahead of the surplus removing station by a device which forms signals denoting fluctuations of the surplus in the stream. Such signals are used to regulate the quantity of surplus in the stream. The signals can denote the mass of tobacco per unit length or multiple unit length of the stream, the density of successive unit lengths or multiple unit lengths of the stream, or the so-called standard deviation of the height or another parameter of the stream from a median value.

31 Claims, 2 Drawing Sheets

METHOD OF AND APPARATUS FOR MAKING A ROD OF FIBROUS MATERIAL

BACKGROUND OF THE INVENTION

The invention relates to improvements in methods of and in apparatus for converting streams of particulate material into rods, especially to improvements in methods of and in apparatus for converting streams of fibrous material of the tobacco processing industry into continuous rod-like fillers. Still more particularly, the invention relates to improvements in a method of and in an apparatus for converting a surplus-containing stream of fibrous material into a rod by removing the surplus from the stream.

As used herein, the term "fibrous material" is intended to embrace natural, artificial and reconstituted tobacco as well as filter materials for the making of mouthpieces which are assembled with rod-shaped tobacco-containing articles to form filter cigarettes, cigars or cigarillos. The invention will be described mainly in connection with the making of plain cigarettes; however, the method and apparatus of the present invention can be utilized with equal or similar advantage for the making of rods which can be converted into other types of rod-shaped articles of the tobacco processing industry.

A cigarrette rod making machine employs a distributor which delivers fragmentized particles of tobacco leaves, fragmentized sheets of reconstituted tobacco and/or fragments of artificial tobacco to a stream building zone wherein the particles form a continuous stream. Such stream contains a surplus of fibrous material and is converted into a continuous rod during travel with a conveyor past a trimming or equalizing device which removes the surplus. The resulting rod (also called filler) is thereupon condensed and draped into a web of cigarette paper or other suitable wrapping material to form with the weeb a cigarette rod which is subdivided (e.g., by a conventional cutoff) into sections of unit length or multiple unit length. The thus obtained cigarettes are delivered to storage, to a packing machine or to a filter tipping machine. Certain types of filter rod sections are or can be produced in a similar manner except that the fibrous material which forms the stream is a substance which intercepts certain presumably harmful ingredients of tobacco smoke when it constitutes the rod-shaped component of the filter mouthpiece in a filter cigarette.

It is further known to monitor one or more characteristics of the stream and/or rod during the making of cigarettes. To this end, the stream or the rod is caused to pass along one or more monitoring devices which are designed to ascertain the density of successive increments of conveyed fibrous material, the mass of fibrous material in successive increments of the stream or rod, or the height of successive increments of the stream or rod.

In certain recent types of cigarette making machines, the distributor (also called hopper) is designed to draw fibrous material from a magazine, to convert the withdrawn material into a thin running layer or carpet, and to feed successive increments of the leader of the carpet into a pneumatic conveyor which delivers fibrous material to a suction conveyor in the stream building zone. The suction conveyor normally constitutes an endless foraminous belt conveyor one side of which is adjacent a suction chamber so that the fibrous material leaving the pneumatic conveyor is attracted to the other side of the foraminous conveyor where it grown into a continuous stream which contains a surplus of fibrous material. The term "surplus" or "excess" denotes that additional quantity of fibrous material which must be removed from the stream in order to transform the latter into a rod which is ready to be converted into the filler of a cigarette rod offering a requisite resistance to compression. The trimming or equalizing device removes the surplus from successive increments of the moving stream, and such surplus is normally returned to the distributor wherein it is mixed with fresh fibrous material prior to being returned to the stream building zone.

In order to ensure the making of a satisfactory rod, it is desirable to form the stream with a high percentage of surplus so as to guarantee that eventual unevennesses of the stream will not influence the quality of the ultimate products, i.e., that the trimming device will be required to remove at least some surplus from each and every increment of the stream. On the other hand, it is also desirable to form the stream with a minimum of surplus because the removed surplus includes, at least in part, relatively short (less desirable) tobacco shreds and the particles which form the surplus are likely to undergo additional comminution and/or to change their moisture content during transport from the trimming station back to the distributor. In other words, it is desirable to form the stream with a surplus which contains sufficient quantities of fibrous material to ensure the making of a high-quality product but is not excessive so that it will not entail unnecessary comminution, drying and/or other undesirable changes of characteristics of fibrous material which must be returned to the distributor for renewed delivery into the stream building zone.

As a rule, a stream of tobacco shreds or similar fibrous material will be formed on the foraminous belt conveyor between two lateral walls so that three of four sides of the stream are shaped by the adjacent surfaces of the conveyor and of the lateral walls. However, the fourth side (opposite the conveyor) normally exhibits more or less pronounced hills and valleys which are unavoidable (at least by resorting to heretofore known distributors) when the material of the stream consists of more or less interlaced shreds including longer and shorter shreds in an infinite number of different orientations. The parameters which influence the development and the pronouncedness of hills and valleys at one side of the fully grown stream which advances toward the trimming station in a cigarette rod making machine include the ratio of short and long shreds in the stream, the blend (i.e., the ratio of two or more types of tobacco in the stream), the temperature of fibrous material, the moisture content of fibrous material, the quality of the distributor and certain others.

Certain presently known proposals to influence the making of a continuous stream of fibrous material in such a way that the stream will contain adequate quantities of surplus but that the surplus will not be excessive are disclosed in commonly owned U.S. Pat. No. 3,132,650 to Richter, in U.S. Pat. No. 3,338,247, in commonly owned U.S. Pat. No. 4,063,563 to Lorenzen, in commonly owned U.S. Pat. No. 4,190,061 to Heitmann, in commonly owned U.S. Pat. No. 4,556,071 to Hoffmann and in British Pat. No. 2,134,367.

OBJECTS AND SUMMARY OF THE INVENTION

An object of the invention is to provide a novel and improved method of optimizing the quantity of surplus in a stream of comminuted tobacco leaves, filter material or other particulate material of the tobacco processing industry in a simple, inexpensive and reliable manner.

Another object of the invention is to provide a method of the just outlined character which takes into full consideration unavoidable fluctuations of the rate of admission of comminuted tobacco or other fibrous material of the tobacco processing industry into the stream building zone.

A further object of the invention is to provide a novel and improved method of monitoring the variable parameters of the trimmed and untrimmed stream and of processing the thus obtained information with a view to maintain the quantity of surplus in the stream within an optimum range.

An additional object of the invention is to provide a method which can be practiced in existing cigarette rod making, filter rod making and like machines.

Still another object of the invention is to provide a novel and improved cigarette making method.

Another object of the invention is to provide a novel and improved apparatus for the practice of the above outlined method.

A further object of the invention is to provide the apparatus with novel and improved means for monitoring the stream ahead of and downstream from the trimming station and with novel and improved means for processing the thus obtained information.

An additional object of the invention is to provide an apparatus which ensures that the quantity of surplus in a continuous tobacco stream is kept to a minimum but is not less than that which is required to invariably produce a satisfactory rod.

Another object of the invention is to provide novel and improved means for controlling the operation of the trimming device in a cigarette rod making machine.

A further object of the invention is to provide an apparatus which exhibits the above outlined features and advantages and can be installed in existing cigarette rod making or like machines for the processing of fibrous material of the tobacco processing industry.

One feature of the present invention resides in the provision of a method of converting into a rod a surplus-containing stream of fibrous material wherein the quantity of surplus fluctuates. The method comprises the steps of forming (first) signals each of which has at least one variable characteristic indicative of fluctuations of the surplus in a portion of the stream, regulating the quantity of surplus in the stream as a function of the variable characteristic of such signals, and thereafter removing the surplus from the stream so that the stream which is relived of the surplus constitutes a continuous rod. The regulating step includes selecting the total quantity of fibrous material in the stream, i.e., the quantity which is required to form the rod and the quantity which constitutes the surplus and is separated from the major part of the stream (i.e., from the material which forms the rod) in the course of the removing step. The stream can consist of or contain natural, reconstituted and/or artificial tobacco. The signal forming step preferably includes forming a series of successive (first) signals whose characteristics are indicative of fluctuations of surplus in predetermined lengths of the stream.

The characteristics of first signals can indicate the so-called standard deviations of the respective portions of the stream prior to removal of surplus from such stream portions. Standard deviation (sigma) is a parameter which is highly satisfactory in connection with the determination of fluctuations of the surplus in the stream and can be calculated in accordance with the equation $$\sigma = \sqrt{\frac{\sum_{i=1}^{n} (X1 - X1i)^2}{n - 1}}$$

wherein X1 is the arithmetic average value of a signal denoting the fluctuations of surplus in a predetermined length of the stream, Xli is the signal denoting the fluctuations of surplus in a unit length or increment of the stream, and n is the number of signals Xli which are processed to form a signal X1.

In order to ascertain the quality of the rod which is obtained by removing the surplus from the stream, it is advisable that the method further include the step of generating additional signals denoting at least one parameter of successive portions of the rod. Such signal generating step is carried out prior to the rod densifying step and prior to the step of draping the densified rod into a web of cigarette paper or other suitable wrapping material.

In accordance with a presently preferred embodiment, the method further comprises the steps of generating second signals S2 (such as the aforementioned additional signals) each of which indicates at least one parameter of a portion of the rod, generating third signals X1 each of which denotes at least one parameter of a portion of the stream, and generating fourth signals (X2−X1 or X1/X2) each of which is a difference or a quotient of a second and a third signal. Each second signal can denote at least one parameter of a predetermined length of the rod, and each third signal can denote at least one parameter of a predetermined length of the stream.

The regulating step can include comparing signals denoting n standard deviations with the fourth signals (each of which is assumed to equal X2−X1) and selecting the quantity of surplus as a function of the difference between n standard deviations and the fourth signals (X2−X1). In accordance with this method, n is a whole number including one (in accordance with a presently preferred embodiment, n equals three).

Alternatively, the regulating step can include selecting the quantity of surplus as a function of signals denoting n standard deviations and as a function of fourth signals each of which is assumed to equal X1/X2.

Regardless of whether the regulating step is influenced by the difference (X2−X1) or by the quotient (X1/X2) of the second and third signals, the surplus will be larger if the standard deviation sigma is greater, i.e., the quantity of surplus will be increased if the deviations of density and/or mass of fibrous material from a median value are more pronounced. The regulating step then includes causing the distributor to admit larger quantities of fibrous material into the stream building zone. Alternatively, the distributor will be adjusted to reduce the rate of admission of fibrous material into the stream building zone if the standad deviation (from the aforementioned median value) is less pronounced.

The signal forming step can include a capacitive measurement of fluctuations of the (mass or density of) surplus in successive portions of the stream. The fibrous material then constitutes a dielectric between the electrodes of the capacitor. Alternatively, the signal forming step can include directing a beam of penetrative radiation (such as beta rays, X-rays or infrared light) against successive portions of the moving stream and generating preferably electric signals (such signals can be readily processed) denoting the intensity of radiation which penetrates through the stream. It is also within the purview of the invention to resort to a signal forming step which includes monitoring the height of successive increments of the moving stream, especially optically scanning the height of successive increments of the stream, and generating electric signals denoting the monitored height.

Another feature of the present invention resides in the provision of an apparatus for converting into a rod a surplus-containing stream of fibrous material, particularly natural, artificial and/or reconstituted tobacco. The apparatus comprises conveyor means defining an elongated path, and adjustable means (such as the aforediscussed distributor or hopper) for supplying fibrous material into a first portion of the path so that the thus supplied material forms a continuous stream which contains a surplus of fibrous material, wherein the quantity of surplus fluctuates, and which advances along the path in a predetermined direction. the apparatus further comprises (trimming or equalizing) means for removing the surplus from successive increments of the stream in a second portion of the path downstream of the first portion so that the trimmed or equalized stream constitutes a rod which advances along the path, means for forming (first) signals each of which has at least one characteristic indicating fluctuations of the surplus in successive increments (e.g., unit lengths or multiple unit lengths) of the stream ahead of the second portion of the path, and means for adjusting the supplying means as a function of the aforementioned characteristic of the signals. Such characteristics is or can be the height of successive increments of the stream and/or the mass or density of successive increments of the stream.

The signal forming means can include or cooperate with a switching circuit or other suitable means for forming signals which denote so-called standard deviations of successive increments of the stream in the aforementioned path. Standard deviation (sigma) can be ascertained in a manner as outlined hereinabove.

The apparatus can further comprise means for generating second signals denoting at least one parameter of successive portions of the rod downstream of the second portion of the path, and means for generating third signals (such signal generating means can include the aforementioned signal forming means) which denote at least one parameter of successive portions of the stream ahead of the second portion of the path, and means (e.g., a function generating circuit) for processing the second and third signals. The two signal generating means can but need not be of identical design. The processing means can include means for forming quotients of the third and second signals (particularly if the monitored parameter of the stream and rod is the mass of fibrous material per unit length of the stream or rod); alternatively the processing means can form differences of the second and third signals (especially if the monitored parameter is the density of the rod and stream).

The means for generating second signals can include means for generating a succession of second signals each of which is an integral of signals denoting the at least one parameter of all increments of a relatively long or relatively short portion of the rod, and the means for generating the third signals can include means for generating a succession of third signals each of which is an integral of signals denoting the at least one parameter of all increments of a relatively long or relatively short portion of the stream.

The rod is thereupon densified and draped into a web of cigarette paper or other suitable wrapping material, and the means for generating second signals is preferably adjacent the path of the rod between the second portion of the path (locus of the trimming means) and a third portion of the path (for the densifying and draping means).

If the signal processing means includes means for generating fourth signals which denote the differences of the second and third signals (each such second and third signal can denote the density of the rod and stream, respectively), the signal forming means can include the aforementioned switching circuit for the generation of (first) signals which denote standard deviations of successive increments of the stream between the first and second portions of the path. The means for generating fourth signals then preferably comprises means for comparing signals denoting n (a whole number including one) standard deviations with the fourth signals and the adjusting means includes means for influencing the supplying means in dependency upon changes of differences between the fourth signals and signals denoting n standard deviations.

If the fourth signals are quotients of the third and second signals (especially if the third and second signals denote the mass of fibrous material in the respective portions of the stream and rod), the signal forming means can include the aforementioned switching circuit which forms signals denoting standard deviations of successive increments of the stream in the path, and the means for forming fourth signals can include function generating means for forming fifth signals each of which is a function of a signal denoting n (a whole number including one) standard deviations and one of the fourth signals. The adjusting means then includes means for influencing the supplying means as a function of the fifth signals.

The signal forming means can include means for optically monitoring the height of successive increments of the stream ahead of the second portion of the path. Alternatively, the signal forming means can include means for capacitively monitoring successive increments of the stream ahead of the second portion of the path. Still further, the signal forming means can include means for directing at least one beam of penetrative radiation against the stream from one side of the path so that the intensity of radiation which penetrates through the stream is indicative of the fluctuations of surplus in the respective increments of the stream, and transducer means serving to generate signals (preferably electric signals) denoting the intensity of radiation penetrating through successive increments of the stream. For example, the directing means can include a source of beta rays, a source of X-rays or a source of infrared light.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
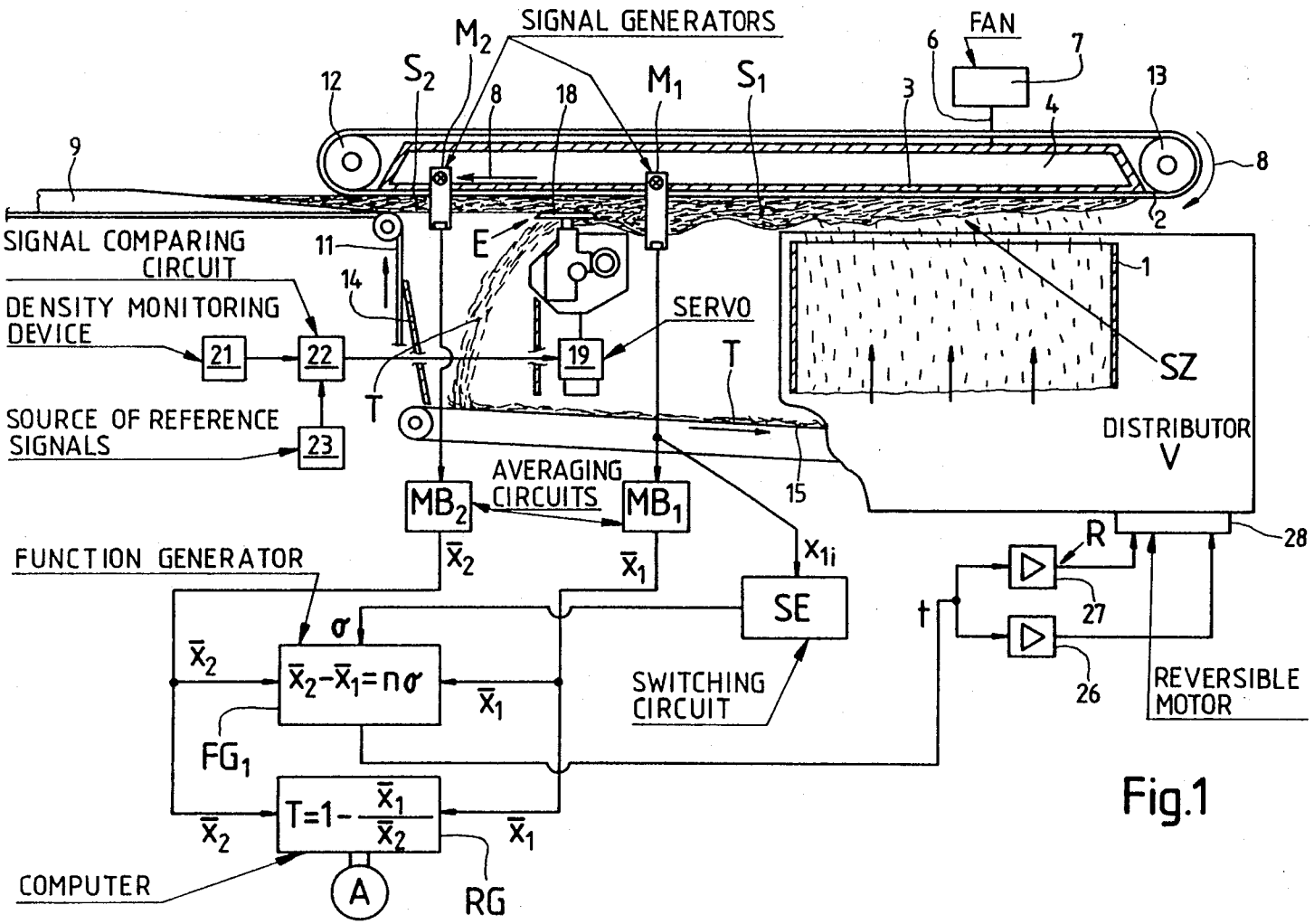
FIG. 1 is a schematic partly elevational and partly vertical sectional view of a portion of a cigarette rod making machine which embodies one form of the improved apparatus, the rate of admission of fibrous material into the stream forming zone being regulated as a function of standard deviation as well as a function of the difference of second and third signals.

FIG. 1 shows an apparatus which is incorporated into a cigarette rod making machine (such as a machine known as VE 80 which is distributed by the assignee of the present application) and includes a distributor (also called hopper) V serving as an adjustable means for supplying variable quantities of fibrous material (in the illustrated apparatus the fibrous material consists of particles of natural, reconstituted and/or artificial tobacco) into a stream building or stream growing zone SZ occupying a first portion of an elongated path which is defined by the lower reach of an endless foraminous belt conveyor 2. The distributor V includes a source of fibrous material and a system of belt conveyors, ducts, carded drums, picker rollers, apron conveyors, pneumatic conveyors and/or other components which transport variable quantities of fibrous material into a duct 1 which can be said to constitute an element of the distributor V and conveys a rising shower of fibrous material into the stream building zone SZ. For example, the distributor V can be constructed and can operate in a manner as disclosed in commonly owned U.S. Pat. No. 4,373,538 to Steiniger. The conveyor 2 is permeable to light.

The conveyor 2 is trained over pulleys 12 and 13 one of which is driven in a manner not shown but well known from the art of cigarette rod making machines to advance the lower reach of the conveyor in a predetermined direction as indicated by the arrows 8. The lower reach of the conveyor 2 travels along the underside of an air-permeable wall 3 (e.g., a perforated metallic panel) constituting the bottom wall of a suction chamber 4. The latter is connected with the air intakes of one or more suction generating devices 7 (e.g., one or more fans) by one or more conduits 6 so that the chamber 4 establishes and maintains a pressure differential at opposite sides of the lower reach of the conveyor 2 and thus ensures that the growing stream of fibrous material advances with the conveyor 2 in direction which is indicated by arrows 8. The fully grown stream is shown at S1; such stream contains a surplus T of fibrous material.

The means for removing the surplus T from successive increments of the fully grown stream S1 comprises a conventional trimming or equalizing device E which preferably comprises two coplanar discs 18 (one can be seen in FIG. 1) serving to clamp the stream from opposite sides of the path which extends along the underside of the lower reach of the conveyor 2 so that the surplus T projects downwardly beyond the common plane of the discs 18, and a paddle wheel, a milling tool or another suitable material removing device (not shown) which sweeps the surplus away at the undersides of the discs 18 so that the surplus forms a flow which descends onto the upper reach of the endless belt conveyor 15 serving as a means for returning the surplus into the magazine of the distributor V. A suitable trimming device is disclosed, for example, in commonly owned U.S. Pat. No. 4,651,755 to Rudszinat.

The trimmed stream constitutes a continuous filler or rod S2 which advances along the path defined by the lower reach of the conveyor 2 and is densified downstream of the path portion where the surplus T is removed by the trimming device E, namely in a wrapping mechanism 9 which drapes the rod S2 into a continuous web 11 of suitable wrapping material (such as cigarette paper, imitation cork or the like) to convert the rod S2 into a continuous cigarette rod (not shown) which is subdivided into a file of discrete rod-shaped articles (cigarettes of unit length or multiple unit length) by a conventional cutoff which is not shown in FIG. 1. The machine which embodies the improved apparatus further comprises a customary paster (not shown) which applies one or more films of suitable adhesive to one marginal portion of the web 11 ahead of the wrapping mechanism 9 wherein such one marginal portion is folded over the other marginal portion to form therewith an elongated seam extending in parallelism with the axis of the cigarette rod. The reference character 14 denotes a funnel which serves to direct successive increments of the removed surplus T from the trimming or equalizing station onto the upper reach of the belt conveyor 15.

The plane of the trimming discs 18 can be moved up and down by a reversible servomotor 19 to thereby select the quanity of fibrous material in successive increments of the rod S2. The servomotor 19 receives appropriate signals from a signal comparing circuit 22 having a first input connected with the transducer of a nuclear density monitoring device 21 and a second input connected with a source 23 of reference signals which denote the desired quantity of fibrous material per unit length of the rod S2. When the intensity and/or another characteristic of the signal from the density monitoring device 21 deviates from the reference signal, the circuit 22 transmits to the servomotor 19 a signal which causes the trimming discs 18 to rise or fall so as to ensure that the quantity of fibrous material in successive increments of the rod S2 again corresponds to that which is denoted by the intensity and/or another characteristic of the reference signal from 23. The density monitoring device 21 can be of the type known as NSR which is distributed by the assignee of the present application; such monitoring device employs a source of beta rays for emission of at least one beam which is directed against the rod S2, against the cigarette rod or against successive discrete cigarettes of unit length or multiple unit length at one side of the path for the rod or cigarettes, and an ionization chamber or any other suitable transducer capable of generating electric signals whose intensity and/or another characteristic is indicative of the intensity of radiation that has penetrated through successive increments of the rod or through discrete cigarettes. it is also possible to employ a density monitoring device which operates with a source of infrared light and an optoelectronic transducer. Reference may be had to commonly owned copending patent application Ser. No. 760,995 to Andrzej Radzio.

The distributor V comprises means for admixing the returned surplus T to fresh fibrous material or for otherwise ensuring that the material which is returned by the belt conveyor 15 will be caused to reenter the stream building zone SZ in an acceptable or optimum distribution with fresh fibrous material.

Successive increments of the stream S1 ahead of that (second) portion of the path where the trimming device E removes the surplus T are monitored by a signal forming device M1 having a radiation source at one side and an optoelectronic or another suitable transducer (e.g., a radiation chamber) at the opposite side of the path between the stream building zone SZ and the trimming device E. A similar signal forming or signal generating device M2 is installed adjacent the path of movement of successive increments of the rod S2, i.e., downstream of the trimming device E but upstream of the wrapping mechanism 9. The devices M1 and M2 respectively transmit signals X1 and X2. Signals X1 can denote the densities of successive increments of the unequalized stream S1 (i.e., of the stream which still contains the surplus T), and signals X2 can denote the densities of successive increments of the rod S2 (equalized tobacco stream S1). Signals X1 exhibit characteristic which are indicative of the mass flow of density of fibrous material in the stream S1, and signals X2 exhibit characteristics which are indicative of the mass flow or density of fibrous material in the rod S2. The outputs of transducers forming part of the signal forming or generating devices M1, M2 are respectively connected with averaging circuits MB1 and MB2 each of which is designed to average a series of signals which are obtained in response to monitoring of predetermined lengths of the stream S1 and rod S2, respectively. The output of the averaging circuit MB1 transmits integrated signals X1, and the output of the averaging circuit MB2 transmits integrated signals X2.

Each of the devices M1, M2 can comprise a source of beta rays, X-rays or infrared rays (or any other suitable penetrative radiation) at one side of the respective portion of the path for the stream S1 and rod S2, and a suitable transducer (such as an ionization chamber in the case that the source emits corpuscular radiation or an optoelectronic transducer if the source emits infrared rays). The intensity of signals X1 at the output of the device M1 is less pronounced than that of signals X2 at the output of the device M2 because the beam of radiation which is emitted by the source forming part of the device M1 must penetrate through successive increments of the stream S1 (i.e., of a flow of fibrous material which contains fibrous material for the corresponding increment of the rod S2 as well as fibrous material for the corresponding increment of the flow of surplus fibrous material T which is removed by the trimming device E).

The quantity of fibrous material which constitutes the surplus T can be defined by the equation $$T=1-X1/X2.$$

The quality of the rod S2 (and hence of discrete cigarettes) depends considerably upon the selection of surplus T in successive increments of the stream S1. Thus, the level of any portion of the exposed surface at the underside of the stream S1 ahead of the trimming device E should not be located above the common plane of the trimming discs 18. As a rule, and as shown (greatly exaggerated) in FIG. 1, the surface of the underside of the stream S1 exhibits alternating hills and valleys which must be eliminated by the trimming device E so that the surface at the underside of the rod S2 will be parallel with the surface at the underside of the respective portion of the lower reach of the conveyor 2 downstream of the surplus removing station. This means that the valleys should not extend to, and especially not above, the selected level of the common plane of trimming discs 18. Otherwise, the respective portions of the rod S2 would be too soft which would be annoying to the purchaser of cigarettes or filter cigarettes embodying the corresponding portions of the rod S2.

On the other hand, the stream S1 should not carry unncessary surplus T because the particles which form the surplus are comminuted and/or otherwise mistreated at the trimming station, during transport (via 14 and 15) back to the distributor V, as well as during mixing with fresh fibrous material on their way from the magazine of the distributor V to the stream building zone SZ. The intensity of pronouncedness of undulation of the surface at the underside of the stream S1 (i.e., the depth of valleys and the height of hills) depends on a number of factors such as the nature of the mixture of two or more types of tobacco which form the stream S1, the extent (uniformity or lack of uniformity) of distribution of two or more types of tobacco which is showered by the duct 1 into the stream building zone SZ, the percentage of long tobacco shreds to shorter tobacco shreds in the returned surplus and in the fresh fibrous material in the magazine of the distributor V, the moisture content of fibrous material which is to form the stream S1 and/or many others. At least one of these factors can change imperceptibly (normally or often gradually) while the cigarette rod making machine is in use to thereby cause a deepening of the valleys and/or a heightening of the hills.

A rather satisfactory indicator of fluctuations of the quantity of fibrous material in successive increments (such as unit lengths or other selected lengths) of the stream S1 is the extent to which the density of the mass flow of fibrous material which forms the stream S1 deviates from a median value. It was further discovered that a particularly accurate indicator of such fluctuations is the so-called standard deviation (sigma) which can be defined by the equation $$\sigma = \sqrt{\frac{\sum_{i=1}^{n} (X1 - X2)^2}{n-1}}$$

wherein X1 is a signal denoting the average density (corresponding to the arithmetic median value of individual signals Xli which are transmitted by the output of the transducer forming part of the monitoring device M1) and n is the number of individual or instant signals Xli which are averaged to form a signal X1. Circuitry which can be used to generate signals denoting standard deviations of density of a stream of fibrous material is well known; reference may be had to U.S. Pat. No. 3,515,860 and/or to U.S. Pat. No. 3,738,376.

Successively formed individual or instant signals Xli are transmitted to a switching circuit SE (e.g., a computer) which ascertains the standard deviation sigma and transmits appropriate signals to the corresponding input of a function generating circuit FG1. Each individual signal Xli can already constitute a signal which is obtained from a series of "instant" signals each denoting the density of an even shorter increment or unit length of the stream S1. In other words, each signal Xli can constitute an averaged signal, and each signal X1 can correspond to the average value of a number of signals Xli, i.e., each signal X1 can denote the average density of a selected portion of the stream S1, such portion having a predetermined length which can be a multiple of a shorter unit length. Each signal X1 can be obtained (transmitted by the averaging circuit MB1) in response to monitoring of the density of a relatively short portion of the stream S1, and the signals (sigma) at the output of the switching circuit SE can be obtained as a result of monitoring of the density of a much (or at least slightly greater) length of the stream S1. Alternatively, the value of sigma can be calculated on the basis of monitoring of the density of the same length (or nearly the same length) of the stream S1 as that which must be monitored in order to enable the averaging circuit MB1 to transmit a signal X1.

A circuit RG (such as a computer) processes te signals X1 and X2 to calculate the quantity of surplus T, and a corresponding signal is displayed at A. As mentioned above, the quantity of surplus T is calculated in accordance with the equation $T=1-X1/X2$.

The outputs of the averaging circuits MB1 and MB2 are further connected to the corresponding inputs of the function generating circuit FG1 which has a third input connected to the output of the switching circuit SE. The circuit FG1 processes the signals sigma, X1 and X2 in that it compares the difference of signals X2 and X1 with n. sigma wherein n is a whole number including one. As explained above, the intensity of each signal X2 normally exceeds that of the corresponding signal X1 because the quantity of fibrous material per unit length of the stream S1 exceeds the quantity of fibrous material per corresponding unit length of the rod S2. In other words, and if the devices M1 and M2 employ sources of penetrative radiation, radiation which issues from the source of M1 encounters greater resistance to penetration through the stream S1 than the radiation issuing from the source of the device M2 and penetrating through successive increments of the rod S2. The signal t at the output of the function generating circuit FG1 is a function of the difference of $X2-X1$ as well as a function of n.sigma. Thus, as the intensity of the signal sigma increases (i.e., when the standard deviation increases), the intensity of the signal t (which is indicative of the surplus in the corresponding portion of the stream S1) also increases, and the intensity of signal t decreases in response to a decrease of the value of $X2-X1$. The signal t is transmitted to a regulating unit R which adjusts the distributor V in dependency on changes of characteristics of the signal t, i.e., as a function of fluctuations of the surplus T in successive increments, unit lengths or otherwise selected predetermined lengths of the stream S1. The regulating unit R comprises two amplifiers 26, 27 which are connected with the corresponding inputs of a servomotor 28 serving as a means for regulating the rate of admission of fibrous material to the stream building zone SZ. One of the amplifiers 26, 27 receives and transmits a signal when the signal t has a positive sign (i.e., when the rate of admission of fibrous material into the stream building zone SZ is to be increased), and the other of these amplifiers receives and transmits negative signals t denoting that the quantity of fibrous material which is being supplied to the duct 1 of the distributor V must be reduced. The exact details of a suitable regulating or adjustng unit R are described in commonly owned U.S. Pat. No. 4,556,071 to Hoffmann. For example, the sevomotor 28 can constitute or include a reversible electric or other motor. It will be seen that the unit R can regulate or adjust the quantity of fibrous material which forms the surplus T and which is returned to the distributor V through the funnel 14 and on the upper reach of the belt conveyor 15.

The mode of operation of the apparatus which is shown in FIG. 1 is as follows:

Fibrous material which is showered by the duct 1 of the distributor V is accumulated to form the stream S1 which advances in the direction of arrows 8 and contains fibrous material for the rod S2 as well as the surplus T. The stream S1 is attracted to the underside of the lower reach of the foraminous conveyor 2 by suction in the chamber 4 and is compelled to share the movement of the conveyor so that successive increments of the stream S1 advance through the space between the radiation source and the transducer of the monitoring device M1 and thereupon into the range of the trimming device E where the surplus T is removed while the thus obtained rod S2 continues to advance with the lower reach of the conveyor 2. Successive increments of the rod S2 are draped into the web 11 in the wrapping mechanism 9 so that the rod S2 (which is densified in the mechanism 9) and the tubular envelope which is obtained from the web 11 together form a cigarette rod which is severed at regular intervals by the aforementioned cutoff to yield a file of discrete plain cigarettes of unit length or multiple unit length. Such cigarettes can be admitted into the magazine of a packing machine, into a reservoir, or into a filter tipping machine, e.g., a machine known as MAX or MAX S (both distributed by the assignee of the present application).

The devices M1 and M2 respectively generate signals X1 and X2 denoting the density of the stream S1 and rod S2 and being transmitted to the respective averaging circuits MB1 and MB2. In addition, successively formed signals Xli are transmitted to the switching circuit SE which transmits signals sigma to the corresponding input of the function generating circuit FG1. The outputs of the averaging circuits MB1 and MB2 respectively transmit integrated or averaged signals X1 and X2 which are processed in the function generating circuit FG1 (which transmits signals t to the regulating unit R) and also in the computer RG whose output transmits signals to the display unit A, such signals denoting the quantity of fibrous material in successive increments of the material forming the surplus T.

The presently preferred value of n is three. The servomotor 28 of the regulating unit R adjusts the distributor V in dependency on the characteristics of successive signals t from the output of the function generating circuit FG1 so that the quantity of fibrous material forming the surplus T is a function of X2−X1. If the surface at the underside of the stream S1 exhibits pronounced undulations (hills and valleys), the intensity of the signal t is increased so that the distributor V begins to increase the rate of admission of fibrous material into the stream building zone SZ. If the undulation of the surface at the underside of the stream is less pronounced, the output of the circuit FG1 transmits a weaker signal t and the rate of admission of fibrous material into the duct 1 and thence into the stream building zone SZ is reduced accordingly.

As mentioned above, the switching circuit SE can be designed to process signals each of which represents the average value of two or more successively formed signals Xli. This is often desirable because the regulating unit R is not required to respond at all, even very short-lasting, fluctuations of the quantity of fibrous material in the stream S1. For example, a suitable averaging circuit (not shown) can be installed between the transducer of the signal forming device M1 and the input of the switching circuit SE, and such averaging circuit averages predetermined numbers of successively formed signals Xli to transmit corresponding averaged signals to the switching circuit SE.

Figure 2:
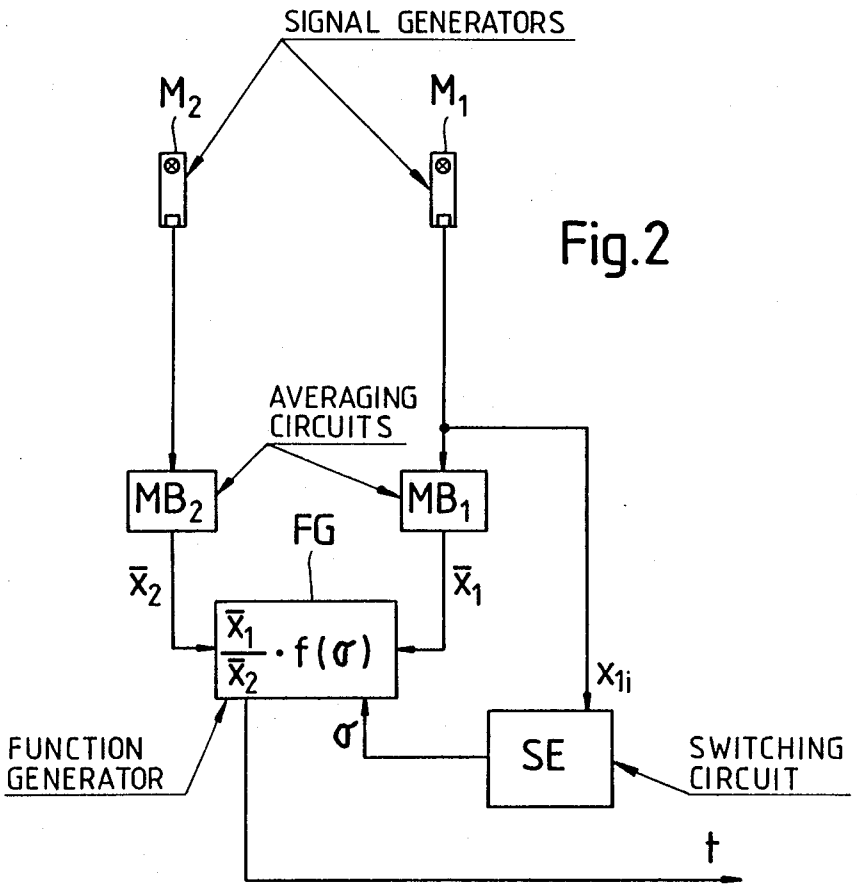
FIG. 2 is a block diagram showing a portion of a second apparatus wherein the rate of admission of fibrous material into the stream building zone is regulated as a function of standard deviation and as a function of the quotient of third and second signals.

FIG. 2 shows a portion of a modified apparatus wherein the function generating circuit FG1 of FIG. 1 is replaced with a function generating circuit FG having means for generating signals t which denote the quotient of signals X1 and X2. While the signals X1 and X2 which are processed in the function generating circuit FG1 and FIG. 1 denote densities of portions of the stream S1 and rod S2, the signals X1 and X2 which are processed in the circuit FG of FIG. 2 are indicative of the mass of fibrous material forming the stream S1 and the rod S2, i.e., the intensity of signals X1 exceeds that the corresponding signals X2 because the mass of an increment of the stream S1 is greater than the mass of an equal increment of the rod S2. Therefore, the quotient X1/X2 is greater than one. The output signal t which is transmitted to the regulating unit R (not shown in FIG. 2) is a function of the quotient of X1 and X2 as well as a function of the extent of standard deviation sigma or n times sigma (n being a while number including one). The exact manner of adjusting the distributor is or can be the same as described in connection with FIG. 1.

Figure 3:
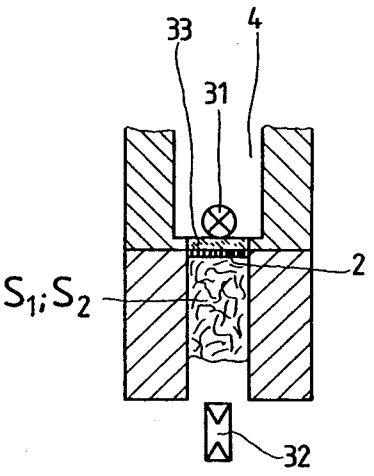
FIG. 3 is an enlarged transverse vertical sectional view of the conveyor means for the stream and rod of fibrous material, further showing one presently preferred form of signal forming or signal generating means.

FIG. 3 shows the details of one of the signal forming or generating devices M1, M2, i.e., the manner of monitoring one or more variable parameters of the stream S1 or rod S2 to generate signals which are indicative of the density or mass of successive increments of the stream or rod. The illustrated signal forming or generating device comprises a source 31 of infrared radiation in the suction chamber 4 in register with a window 33 which is designed to transmit infrared radiation, and a photoelectronic transducer 32 which generates electric signals (X1 and X2) and is adjacent the underside of the stream S1 or rod S2 opposite the source 31. The beam of infrared light penetrates through the window 33 as well as through successive increments of the stream S1 or rod S2 before a portion of such beam reaches the transducer 32. This portion is indicative of density or mass of the respective increment of the stream or rod, and the signal which is generated by the transducer 32 exhibits a characteristic which reflects the thus ascertained density or mass.

Each of the devices M1, M2 can comprise a source of beta rays and a suitable transducer (e.g., an ionization chamber). Reference may be had to British Pat. No. 1,128,003 which describes such a signal forming or generating device. Electrons which issue from the source of beta rays are weakened on their way through the stream S1 or rod S2 in dependency on the density of the corresponding increments of the stream or rod, and the signals which are transmitted by the ionization chamber are indicative of the extent of weakening, i.e., of the density of successive increments of the stream S1 or rod S2.

It is further possible to monitor the density of successive increments of the stream S1 and rod S2 by utilizing devices each of which comprises a source of X-rays. Thus, an X-ray tube is placed adjacent one side of the path of the stream S1 or rod S2, and an array of detectors of X-rays is placed adjacent the other side of the path so as to ascertain the intensity of radiation which has penetrated through the stream or rod. Such device can further comprise an evaluating circuit which rapidly addresses a large number of detectors of X-rays and totalises the signals to thus generate a signal which is indicative of the density of corresponding portion of the stream or rod. Reference may be had to German patent application Ser. No. 36 37 306.0 filed Nov. 11, 1986 and/or to commonly owned copending United States patent application Ser. No. 930,251 filed Nov. 11, 1986 by Hartmann et al.

It is further possible to employ signal forming or generating devices which are designed to capacitively ascertain the densities of successive increments of the stream S1 or rod S2. The fibrous material constitutes the dielectric substance between the electrodes of a capacitor which is connected to a source of high-frequency current. Reference may be had to commonly owned U.S. Pat. No. 4,063,563 to Lorenzen.

Still another possibility of ascertaining the density of successive increments of the stream S1 and/or rod S2 is by employing means for monitoring the height of successive increments of the stream or rod. Reference may be had, for example, to commonly owned U.S. Pat. No. 4,190,061 to Heitmann which describes means for optically monitoring the height of successive increments of a moving stream or rod of fibrous material. In the apparatus of the present invention, such optical monitoring means can be employed to ascertain the height of successive increments of the stream S1 and/or rod S2 by determining the distance between the underside of the lower reach of the conveyor 2 and the undersides of successive increments of the stream S1 ahead of the trimming device E and/or the undersides of successive increments of the rod S2 downstream of the trimming device. The same result can be obtained if the density of the rod S2 is monitored indirectly, namely by monitoring the level of the discs 18 forming part of the trimming device E, or the distance between the common plane of the discs 18 and the underside of the lower reach of the conveyor 2. This is tantamount to a determination of the height of successive increments of the rod S2. The just mentioned monitoring of the level of discs 18 can be performed optically, mechanically or in any other suitable way.

An advantage of the improved method and apparatus is that the rate of admission of fibrous material to the stream building zone SZ is automatically regulated in such a way that the quantity of surplus equals or is close to the minimum quantity which is required to make a satisfactory rod. The method and apparatus automatically conform the rate of admission of fibrous material into the stream building zone to changes or fluctuations of the height of hills and/or the depth of valleys in the exposed surface of the stream S1. This ensures that the apparatus invariably produces a highly satisfactory rod and that the quantity of removed surplus (i.e., of that fibrous material which is likely to be comminuted, dried and/or otherwise undesirably affected during removal from the bulk of the stream and during transport back to the distributor V) is kept to a minimum.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of converting into a rod a surplus-containing stream of fibrous material wherein the quantity of surplus fluctuates, comprising the steps of forming signals each having at least one variable characteristic which is indicative of fluctuations of the surplus in a portion of the stream; regulating the quantity of the surplus in the stream as a function of said variable characteristics of the signals including increasing the quantity of surplus when the fluctuations increase and reducing the quantity of surplus when the fluctuations decrease; and thereafter removing the surplus from the stream.

2. The method of claim 1, wherein the stream consists of or contains natural, artificial and/or reconstituted tobacco.

3. The method of claim 1, wherein said signal forming step includes forming a series of successive signals whose characteristics are indicative of fluctuations of the surplus in successive predetermined lengths of the stream.

4. The method of claim 1, wherein the characteristics of said signals are indicative of standard deviations of the respective portions of the stream prior to removal of surplus from such portions.

5. The method of claim 1, further comprising the steps of generating second signals denoting at least one parameter of successive portions of the rod, thereupon densifying successive portions of the rod, and draping successive portions of the rod into a web of wrapping material.

6. The method of claim 1, further comprising the step of generating second signals each denoting at least one parameter of a portion of the rod, generating third signals denoting at least one parameter of a portion of the stream, and generating fourth signals each of which is a quotient or a difference of a second and a third signal.

7. The method of claim 6, wherein each of said second signals denotes at least one parameter of a predetermined length of the rod and each third signal denotes at least one parameter of a predetermined length of the stream.

8. The method of claim 6, wherein the characteristics of signals which are indicative of fluctuations of the surplus denote standard deviations of the respective portions of the stream prior to removal of the surplus from such portions, each of said fourth signals being a difference of a second and a third signal and said regulating step including comparing signals denoting n standard deviations with said fourth signals and selecting the quantity of surplus as a function of the difference between n standard deviations and said fourth signals, n being a whole number including one.

9. The method of claim 8, wherein n equals three.

10. The method of claim 6, wherein the characteristics of signals which are indicative of fluctuations of the surplus denote standard deviations of the respective portions of the stream prior to removal of the surplus from such portions, each of said fourth signals being a quotient of a third and a second signal and said regulating step including selecting the quantity of surplus as a function of said fourth signals and as a function of signals denoting said standard deviations.

11. The method of claim 1, wherein said signal forming step includes capacitive measurement of fluctuations of the surplus in successive portions of the stream.

12. The method of claim 1, wherein said signal forming step includes directing a beam of penetrative radiation against successive portions of the stream and generating electric signals denoting the intensity of radiation which penetrates through the stream.

13. The method of claim 12, wherein the beam contains beta rays, X-rays or infrared light.

14. The method of claim 1, wherein said signal forming step includes monitoring the height of successive increments of the stream.

15. The method of claim 14, wherein said height monitoring step includes optically scanning the height of successive increments of the stream.

16. Apparatus for converting into a rod a surplus-containing stream of fibrous material, particularly tobacco, comprising conveyor means defining an elongated path; adjustable means for supplying fibrous material into a first portion of said path so that the thus supplied material forms a continuous stream which contains a surplus of fibrous material, wherein the quantity of surplus fluctuates and which advances along said path in a predetermined direction; trimming means for removing the surplus from successive increments of the stream in a second portion of said path downstream of the first portion so that the trimmed stream constitutes a rod which advances along said path; means for forming signals each having at least one characteristic indicating fluctuations of the surplus in successive increments of the stream ahead of the second portion of said path; and means for adjusting said supplying means as a function of said characteristic of said signals including means for increasing the quantity of surplus when the fluctuations increase and for reducing the quantity of surplus when the fluctuations decrease.

17. The apparatus of claim 16, wherein said characteristic is the height of successive increments of the stream.

18. The apparatus of claim 16, wherein said characteristic is the density of successive increments of the stream.

19. The apparatus of claim 16, wherein said signal forming means comprises means for forming signals which denote standard deviations of successive increments of the stream in said path.

20. The apparatus of claim 16, further comprising means for generating second signals denoting at least one parameter of successive portions of the rod downstream of the second portion of said path and means for generating third signals denoting at least one parameter of successive portions of the stream ahead of the second portion of said path, and means for processing said second and third signals.

21. The apparatus of claim 20, wherein said means for generating said third signals includes said signal forming means.

22. The apparatus of claim 20, wherein said processing means includes means for forming quotients of said third and second signals.

23. The apparatus of claim 20, wherein said processing means includes means for generating fourth signals denoting differences of said second and third signals.

24. The apparatus of claim 20, wherein each portion of the stream and each portion of the rod consists of a plurality of successive increments and the means for generating said second signals includes means for generating a succession of second signals each of which is an integral of signals denoting the at least one parameter of all increments of the respective portion of the rod, the means for generating said third signals including means for generating a succession of third signals each of which is an integral of signals denoting the at least one parameter of all increments of the respective portion of the stream.

25. The apparatus of claim 20, further comprising means for densifying successive increments of the rod in a third portion of said path downstream of said second portion, said means for generating second signals being adjacent the rod intermediate the second and third portions of said path.

26. The apparatus of claim 20, wherein said processing means includes means for generating fourth signals denoting the differences of said second and third signals, said signal forming means including means for generating signals denoting standard deviations of successive increments of the stream in said path, said means for generating fourth signals including means for comparing signals denoting n standard deviations with said fourth signals and said adjusting means including means for influencing said supplying means in dependency upon changes of differences between signals denoting n standard deviations and said fourth signals, n being a whole number including one.

27. The apparatus of claim 20, wherein said processing means includes means for generating fourth signals denoting the quotients of said third and second signals, said signal forming means including means for generating signals denoting standard deviations of successive increments of the stream in said path, said means for generating fourth signals including function generating means for forming fifth signals each of which is a function of a signal denoting n standard deviations and one of said fourth signals, n being a whole number including one, said regulating means including means for influencing said supplying means as a function of said fifth signals.

28. The apparatus of claim 16, wherein said signal forming means includes means for optically monitoring the height of successive increments of the stream ahead of the second portion of said path.

29. The apparatus of claim 16, wherein said means for forming signals includes means for capacitively monitoring successive increments of the stream ahead of the second portion of said path.

30. The apparatus of claim 16, wherein said means for forming signals includes means for directing a beam of penetrative radiation against the stream from one side of said path so that the intensity of radiation which penetrates through the stream is indicative of the fluctuations of surplus in the respective increments of the stream, and transducer means arranged to generate signals denoting the intensity of radiation penetrating through successive increments of the stream.

31. The apparatus of claim 30, wherein said directing means includes a source of beta rays, a source of X-rays or a source of infrared rays.

* * * * *